US010343815B2

(12) United States Patent
Brendlinger

(10) Patent No.: US 10,343,815 B2
(45) Date of Patent: Jul. 9, 2019

(54) PALLET DISPLAY ASSEMBLY

(71) Applicant: John R. Brendlinger, Santa Fe Springs, CA (US)

(72) Inventor: John R. Brendlinger, Santa Fe Springs, CA (US)

( * ) Notice: Subject to any disclaimer, the term of this patent is extended or adjusted under 35 U.S.C. 154(b) by 2 days.

(21) Appl. No.: 15/424,645

(22) Filed: Feb. 3, 2017

(65) Prior Publication Data

US 2017/0225825 A1 Aug. 10, 2017

Related U.S. Application Data

(60) Provisional application No. 62/292,184, filed on Feb. 5, 2016.

(51) Int. Cl.

| | |
|---|---|
| ***B65D 19/38*** | (2006.01) |
| ***B65D 19/00*** | (2006.01) |
| ***B65D 5/52*** | (2006.01) |
| ***B65D 19/16*** | (2006.01) |
| *B65D 19/20* | (2006.01) |

(52) U.S. Cl.

CPC ..... *B65D 19/38* (2013.01); *B65D 5/522* (2013.01); *B65D 19/16* (2013.01); *B65D 19/20* (2013.01)

(58) Field of Classification Search

CPC ... A47F 5/10; A47F 5/11; A47F 5/112; B65D 19/44; B65D 19/02; B65D 19/38; B65D 19/20; B65D 71/0096; B65D 5/522; B65D 5/50; B65D 5/52; B65D 19/12; B65D 19/16

USPC ..... 206/386, 600, 766, 45.28; 211/59.4, 72, 211/132.1, 188; 108/56.1, 56.3, 57.16, 108/51.3; 40/617; 229/103.3, 122.24, 229/117.01, 117.05, 117.06, 117.07, 229/117.08, 942, 122.29; 220/617

See application file for complete search history.

(56) References Cited

U.S. PATENT DOCUMENTS

| | | | | |
|---|---|---|---|---|
| 1,156,444 | A * | 10/1915 | Stevens | B65D 5/12 229/122.29 |
| 2,718,996 | A * | 9/1955 | Jamieson | B65D 5/12 229/110 |
| 4,883,221 | A * | 11/1989 | Brundage | B65D 5/0045 229/143 |
| 6,267,255 | B1 | 7/2001 | Brush | |
| 7,681,735 | B2 | 3/2010 | Youell, Jr. | |
| 7,861,865 | B2 | 1/2011 | Green | |
| 8,056,727 | B1 * | 11/2011 | Marsh | B65D 19/38 108/56.3 |
| 2005/0023168 | A1 | 2/2005 | Marnocha | |
| 2005/0236466 | A1 * | 10/2005 | McLeod | B65D 5/4608 229/143 |

* cited by examiner

*Primary Examiner* — Andrew D Perreault

(74) *Attorney, Agent, or Firm* — Robert J. Lauson, Esq.; Lauson & Associates

(57) ABSTRACT

An apparatus for displaying palleted items arranged on a stack of pallets includes a generally flat main panel under the palleted items, having flaps with the palleted items positioned along fold lines, and with separable side panels configured to engage the flaps at the fold lines. When folded away from the palleted items and engaged together, the side panels securely hide the stack of multiple pallets under the palleted items, and present printed sides for advertising.

20 Claims, 4 Drawing Sheets

PALLET DISPLAY ASSEMBLY

This application claims the benefit of the priority filing date of provisional application no. 62/292,184, filed on Feb. 5, 2016, which is incorporated herein in its entirety.

BACKGROUND

1. Field of the Invention

The present invention relates generally to specialty packaging, and more particularly to a pallet display capable of assembly around a pallet stack, and disassembly into a more compact arrangement.

2. Description of the Prior Art

Pallets and similar flat standardized transport structures are known in the art and are used for supporting and transporting collections of small to medium-sized mercantile items. Conventional stocking of store shelves requires unpacking items from pallets, refilling the store shelves with new items and removing the pallets. This process is time consuming and inefficient, resulting in added costs which are passed on to consumers. To avoid these costs, warehouse stores and similar bulk item merchants allow customers to select and procure items directly from the pallets they arrive on, avoiding stocking costs and allowing the stores to pass on the savings to the customers. Warehouse stores account for an increasing share of retail sales as a consequence.

While more efficient and cost-saving from a transport, delivery and stocking perspective, offering items directly on pallets has certain disadvantages in terms of marketing and promotion. First, the pallets themselves are frequently unsightly and the items obscured by packaging inserts or, if small, contained in poorly marked boxes on the pallet. Second, pallets are frequently moved or store layouts changed, making it difficult to find a particular item in the warehouse on a return visit. Additionally, when multiple pallets are stacked atop one another to raise items to an easily accessible height, the items are easier to reach but at the aesthetic cost of several unsightly pallets visible to the customer. To overcome these problems various displays to promote items on pallets have been developed.

U.S. Pat. No. 6,152,305 teaches a pallet display assembly wherein items are packaged in structurally resilient display packs stacked vertically in open boxes from which they may be removed. While such an assembly presents the items upright and renders them easily retrievable, the labels are often too small to be seen from a distance and the assembly works only with items suitable for sturdy display packaging such as vacuum-molded plastic packaging.

To avoid those limitations and provide a larger display area, visible from a distance, various apparatus having large side panels have been developed. The side panels can obscure the pallets on which the items are placed and provide a large surface area to display a variety of marketing indicia.

One such panel system is embodied in U.S. Pat. No. 7,861,865 to Green. Green teaches a packaging assembly including four side panels for covering stacked pallets. The side panels each include a mounting flap and a main flap separated by a fold line. The mounting flap is affixed to a pallet using a stapler or similar method such that the fold line matches the edge of the pallet. Items are installed on the pallet and the main panels fold up adjacent the items prior to use, with a lid necessary to secure them in an upright configuration. To form the display, the mounting flaps are folded down and connected together by affixing a side tab on one flap to an adjacent mounting flap with tape or glue.

Green has several disadvantages. Primarily, it requires affixing the mounting flaps to the pallet. This requires special tools, such as an industrial stapler or hammer in the case of conventional pallets, and other, unspecified fixation methods in the case of resin or metal pallets. Additionally, glue or tape is needed to adhere the side tab of one panel to another panel, thus making break down, removal and recycling the display difficult. Green is also not self-aligning, requiring users to ensure the mounting flaps are affixed to the pallet in just the right position to align the side tabs and panels. If not properly aligned, removing, realigning and reinstalling the mounting panels causes unsightly damage to the display.

Accordingly there is need for an improved panel-type pallet display assembly for use with mercantile items sold directly from pallets that is easy to assemble and disassemble and that overcomes the aforementioned disadvantages inherent in the prior art.

SUMMARY

An apparatus for displaying palleted items arranged on a pallet includes a substantially planar main panel for placement under the palleted items, a first flap hingedly coupled to the main panel along a first fold line, with the palleted items positioned along the first fold line. A second flap is hingedly coupled to the main panel along a second fold line, with the palleted items positioned along the second fold line A first side panel is configured to engage the first flap at the first fold line, and a second side panel is configured to engage the second flap at the second fold line, and the first side panel is configured to engage the second side panel such that when the first side panel and second side panel are folded away from the palleted items and engaged, the first side panel and the second side panel securely hide a predetermined number of pallets under the palleted items.

The apparatus also preferably has a first side panel slot formed along the first fold line between the main panel and the first flap for engaging a first side panel tab, and a second side panel slot formed along the second fold line between the main panel and the second flap for engaging a second side panel tab. The first side panel and the second side panel each comprise a printed side configured to face away from the predetermined number of pallets when the first side panel and the second side panel are folded away from the palleted items.

Preferably, the apparatus includes a locking tab for releasably engaging the first side panel and the second side panel, and the pallet comprises a first top edge in collinear alignment with the first fold line, and a second top edge in collinear arrangement with the second fold line, such that the palleted items are in collinear arrangement with the first fold line and the second fold line. In various alternative embodiments, the first side panel may be shorter in length than the second side panel, the main panel may completely cover the pallet, and the main panel, the first side panel and the second side panel may be made of corrugated cardboard.

The apparatus may also be characterized as an apparatus for displaying palleted items on a pallet, with a substantially planar main panel configured for placement substantially covering the pallet, a first flap foldably attached to the main panel along a first fold line, a first side panel slot formed along the first fold line between the main panel and the first flap and a first side panel having a first printed side, the first side panel foldably attached to a first side panel tab with the first side panel tab sized for insertion into the first panel slot.

The first side panel preferably has a locking tab configured to engage a second side panel having a second printed side, such that when the first side panel and the second side panel are moved away from the palleted items and held together by the locking tab, the first printed side and the second printed side face away from the pallet. Preferably the main panel also includes a second flap hingedly coupled to the main panel along a second fold line having a second side panel slot, and the locking tab may be configured to engage the second side panel such that when the first side panel and the second side panel are folded toward the palleted items, the first printed side and the second printed side face the palleted items.

In various embodiments the main panel may have two opposing first flaps and two opposing second flaps, and the pallet may have a first top edge in collinear alignment with the first fold line, and a second top edge in collinear arrangement with the second fold line. Preferably the first side panel is shorter in length than the second side panel, the main panel completely covers the pallet, the first side panel and the second side panel are sized to hide a predetermined number of stacked pallets, and the main panel, the first side panel and the second side panel are made of corrugated cardboard.

DESCRIPTION

Figure 1:
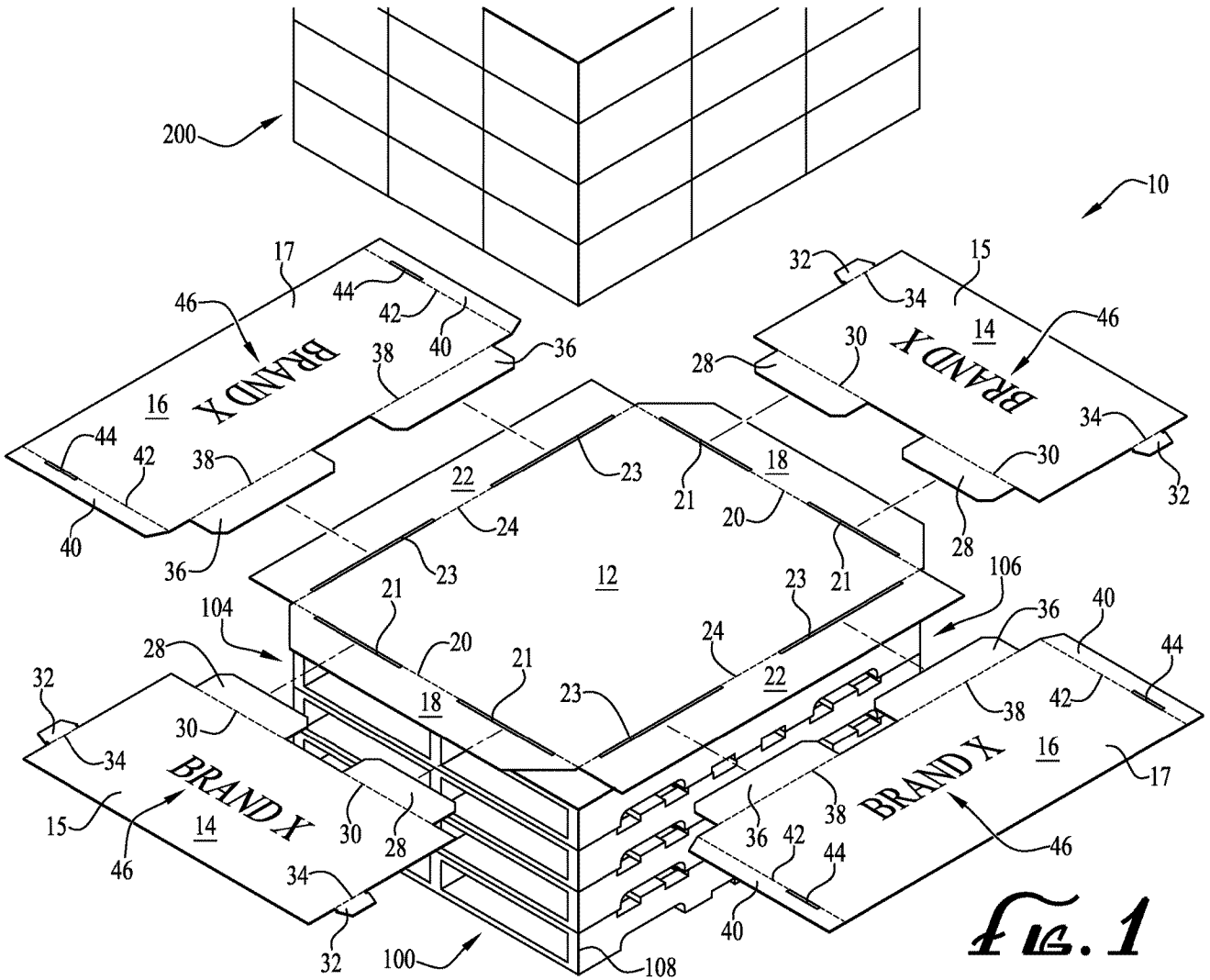
FIG. 1 illustrates an exploded view of a pallet display assembly, including a plurality of pallets and a plurality of assembled items to be displayed on the pallet.

Referring to FIG. 1, a pallet display assembly 10 includes a main panel 12, at least one first or short side panel 14 and at least one second or long side panel 16, all preferably made of corrugated cardboard and corresponding to the standard surface area of commercial pallets 100. The pallets 100 hold and display assembled items 200 to be sold in warehouse store environments. Preferably, two short side panels 14 and two long side panels 16 are used to engage the main panel 12 in order to completely cover the pallets 100. In various embodiments, the short side panels 14 and long side panels 16 may be appropriately sized to cover a predetermined number of stacked pallets 100.

The main panel 12 preferably includes two sets of first or short flaps 18 connected along first or short fold lines 20, and two sets of second or long flaps 22 connected along second or long fold lines 24. The short fold lines 20 and long fold lines 24 correspond to the short top edge 104 and long top edge 106 of the pallets 100, respectively, such that the main panel 12 covers the pallets 100, with the short flaps 18 and long flaps 22 extending over and able to fold down against the pallets 100.

A series of first or short panel slots 21 and second or long panel slots 23 are formed along the short fold lines 20 and long fold lines 24 to align the short side panels 14 and long side panels 16 with the main panel 12. In the illustrated embodiment two short panel slots 21 and two long panel slots 23 are shown along each of the short fold lines 20 and long fold lines 24. In alternative embodiments, other configurations of short panel slots 21 and long panel slots 23 may be positioned according to preference and effectiveness. Preferably, at least one of the short side panels 14 has a first printed side 15, and at least one of the long side panels 16 has a second printed side 17, the first printed side 15 and the second printed side 17 bearing indicia related to the palleted items 200.

Still referring to FIG. 1, each short side panel 14 includes a series of first tabs 28, sized to engage the panel slots 26 along the short fold lines 20. The first tabs 28 are located along first tab fold lines 30 that become collinear with the short fold lines 20 of the main panel 12 when the first tabs 28 are fully inserted into the panel slots 26, thereby allowing the short side panel 14 (along with the short flaps 18) to fold relative to the main panel 12. Each short side panel 14 also includes two locking tabs 32. Each locking tab 32 is located along a locking tab fold line 34. The locking tab fold lines 34 allow each locking tab 32 to engage the long side panels 16 when the short side panels 14 and long side panels 16 are folded down to cover the pallets 100.

Each long side panel 16 includes a series of second tabs 36, sized to engage the panel slots 26 along the long fold lines 24 of the main panel 12. The second tabs 36 are located along second tab fold lines 38 that become collinear with the long fold lines 24 of the main panel 12 when the second tabs 36 are fully inserted into the panel slots 26, thereby allowing the long side panels 16 (along with the long flaps 22) to fold relative to the main panel 12. Each long side panel 16 also includes two corner flaps 40. Each corner flap 40 is connected along a corner flap fold line 42 aligning with a corner 108 of the pallets 100. The corner flaps 40 extend under the short side panels 14 when the pallet display assembly 10 is constructed to create a uniform appearance without the pallets 100 being visible at the corners 108. A locking slot 44 is located along each corner flap fold line 42 for retaining a locking tab 32 when the short side panels 14 and long side panels 16 are folded down over the pallets 100 to retain the pallet display assembly 10 in a displayed position with the first printed side 15 and the second printed side 17 facing outwardly.

The structure of the pallet display assembly 10 having been shown and described, its method of operation will now be discussed.

Figure 2:
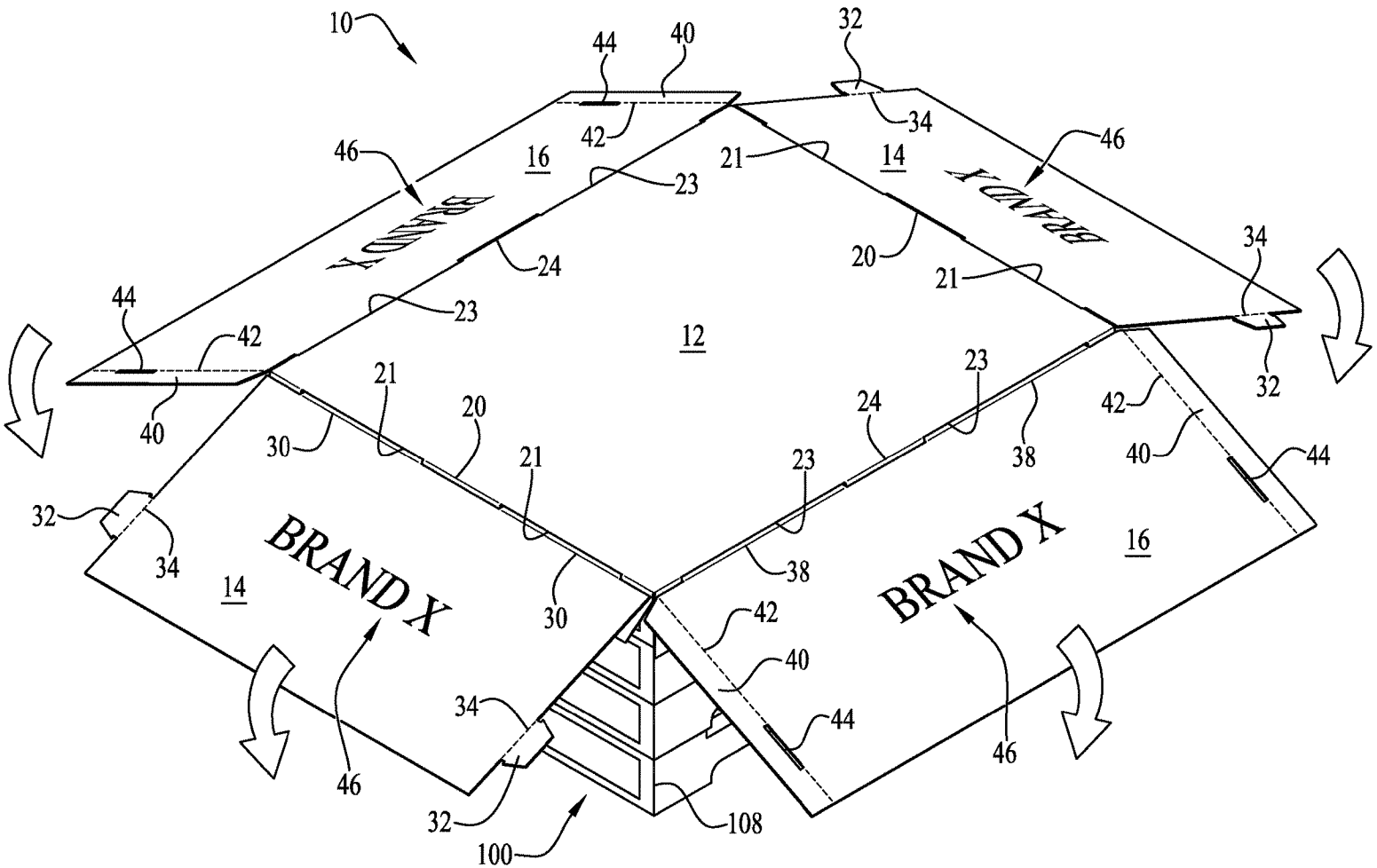
FIG. 2 illustrates the pallet display assembly in a first stage of construction.
Figure 3:
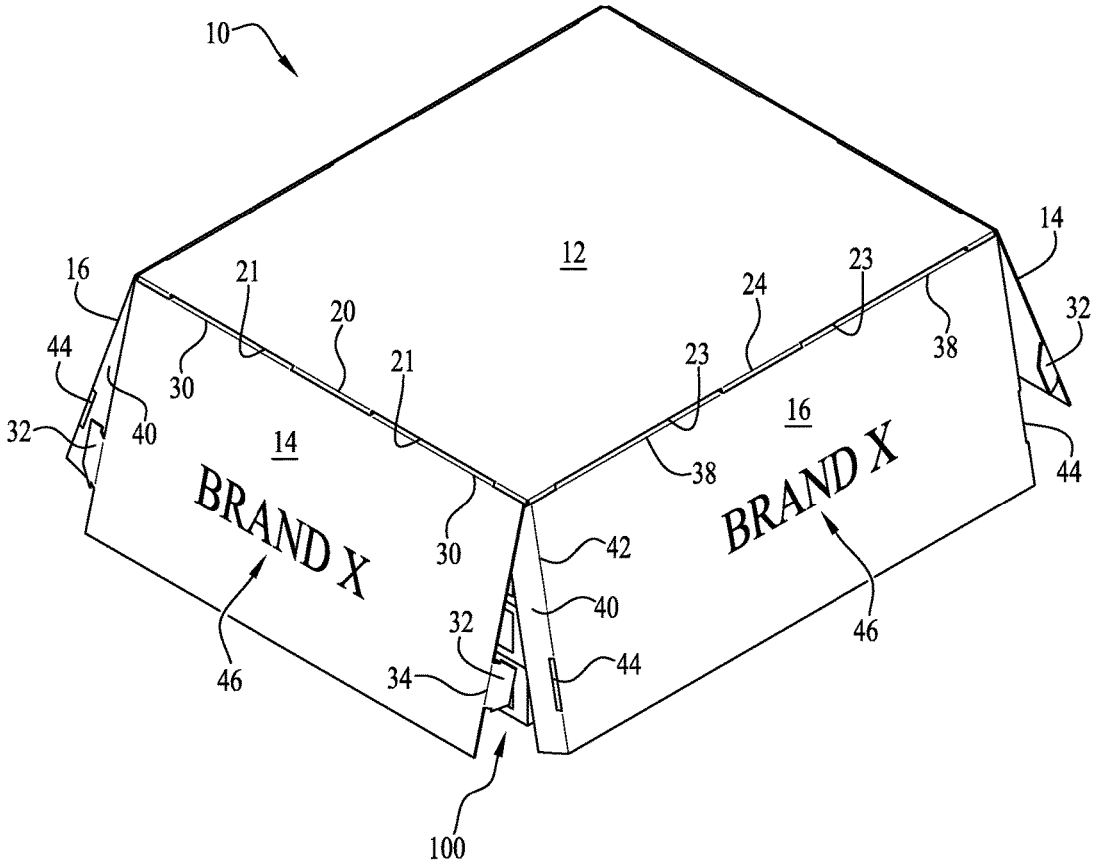
FIG. 3 illustrates the pallet display assembly in a second stage of construction.
Figure 4:
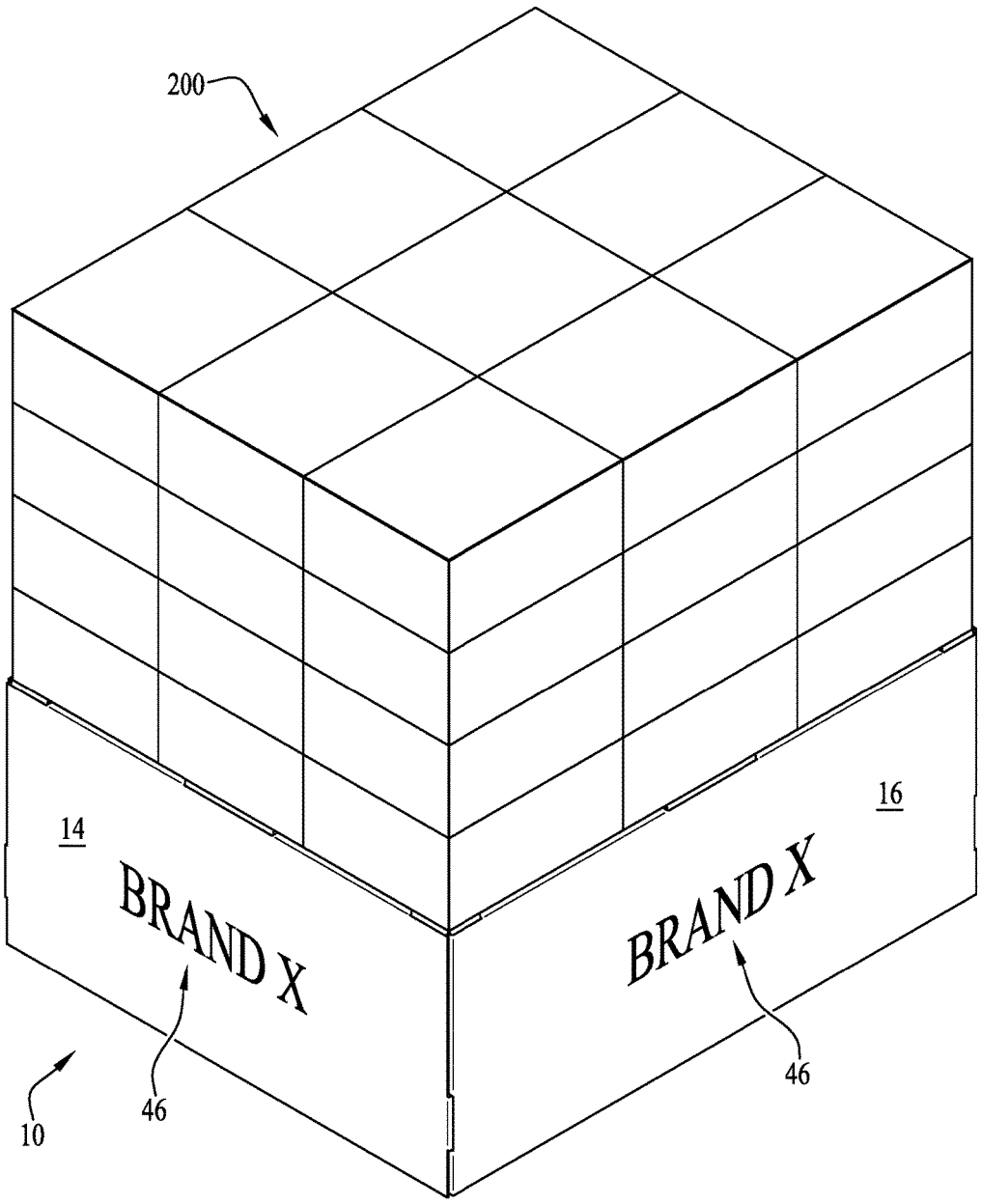
FIG. 4 illustrates the pallet display assembly fully constructed atop the pallets, under the assembled items displayed for sale.

Referring to FIGS. 2-4, in order to install the pallet display assembly 10, the main panel 12 is placed atop the pallets 100 such that the short fold lines 20 and the long fold lines 24 are aligned with the short top edges 104 and the long top edges 106, respectively, of the pallets 100. The short flaps 18 and long flaps 22 extend off the pallets 100 and are folded down along the pallets 100 to make room for the short side panels 14 and long side panels 16. The first tabs 28 and the second tabs 36 are fully inserted into the panel slots 26 such that the first tab fold lines 30 are substantially collinear with the short fold lines 20 and the second tab fold lines 38 are substantially collinear with the long fold lines 24. With the first tabs 28 and second tabs 36 fully inserted into the main panel 12, the short side panel 14 and the long side panel 16 can be folded down to cover the pallets 100.

Still referring to FIGS. 2-4, as the short side panels 14 and the long side panels 16 approach the pallets 100, the corner flaps 40 of the long side panels 16 are folded along each corner flap fold line 42 and inserted under each short side panel 14. The short flaps 18 and the corner flaps 40 may be slanted in profile as illustrated to avoid overlapping when covered by the short side panel 14. As each corner flap 40 travels under a short side panel 14, the locking tabs 32 come within range of the locking slots 44. When the long side panels 16 are folded against the pallets 100, two locking tabs 32 on either side of each short side panel 14 are inserted into the locking slots 44 on either side of each long side panel 16 to lock both the long side panels 16 and the short side panels 14 against the pallets 100.

During installation, at any time after the main panel 12 is placed in position atop the pallets 100 with the first tabs 28 and the second tabs 36 inserted in their respective panel slots 26, the assembled items 200 can be placed atop the main panel 12. With the pallet display assembly 10 covering the pallets 100, customers can view promotions 46 for the assembled items 200 on the short side panel 14 and on the long side panel 16, and at their election, remove one or more of the assembled items 200 for purchase. Once the assembled items 200 are all removed, the pallet display assembly 10 can be easily and conveniently disassembled by disengaging the locking tabs 32 from the locking slots 44, removing the first tabs 28 from the panel slots 26 by pulling each short side panel 14 away from the main panel 12, removing the second tabs 36 from the panel slots 26 by pulling each long side panel 16 away from the main panel 12, and removing the main panel 12 from atop the pallets 100. None of the short side panels 14, long side panels 16, or main panel 12 are affixed to the pallets 100, thereby allowing easy disassembly. Since they lay flat when disassembled, they can also be conveniently stacked, and because no glue or tape is used they can be easily recycled.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. An apparatus for displaying palleted items arranged on a pallet, the apparatus comprising:

at least one pallet having a top surface peripherally defined by a plurality of top edges, the pallet being stackable with at least one other pallet;

a substantially planar main panel disposed over the top surface of the pallet for placing under the palleted items;

a first flap hingedly coupled to the main panel along a first fold line aligned with one of the top edges of the pallet, with the palleted items positioned along the first fold line, a first side panel slot formed along the first fold line;

a second flap hingedly coupled to the main panel along a second fold line aligned with another of the top edges of the pallet, with the palleted items positioned along the second fold line;

a first side panel including a first side panel tab, the first side panel separably engaging the first flap at the first fold line with the first side panel tab passing through the first side panel slot to extend underneath the main panel, the first side panel being detachable from the first flap;

a second side panel separably engaging the second flap at the second fold line, the first and second side panels being detachable from one another;

wherein the first side panel separably engages the second side panel when the first side panel and second side panel are folded away from the top surface extending under the palleted items, wherein the first side panel and the second side panel are substantially adjacent to and securely hide a predetermined number of pallets under the palleted items.

2. The apparatus of claim 1, wherein the first side panel tab is hingedly coupled to the first side panel along a first tab fold line.

3. The apparatus of claim 1 further comprising a second side panel slot formed along the second fold line for engaging a second side panel tab of the second side panel.

4. The apparatus of claim 1 wherein at least one of the side panels have a printed side to face away from the predetermined number of pallets when the side panels are folded away from the palleted items.

5. The apparatus of claim 1 further comprising a locking tab for releasably engaging the first side panel and the second side panel.

6. The apparatus of claim 1 wherein the pallet comprises top edges in collinear alignment with the fold lines.

7. The apparatus of claim 6 wherein the palleted items are in collinear arrangement with the fold lines.

8. The apparatus of claim 1 wherein the first side panel is shorter in length than the second side panel.

9. The apparatus of claim 1 wherein the main panel completely covers the pallet.

10. The apparatus of claim 1 wherein the apparatus is made of corrugated cardboard.

11. An apparatus for displaying palleted items on a plurality of pallets, the apparatus comprising:

at least one pallet having a top surface peripherally defined by a plurality of top edges;

a generally flat main panel disposed over the top surface of the pallet for placement substantially covering the plurality of pallets;

a first flap foldably attached to the main panel along a first fold line aligned with one of the top edges of the pallet;

a first side panel slot formed along the first fold line between the main panel and the first flap;

a first side panel having a first printed side, the first side panel foldably attached to a first side panel tab, the first side panel being detachable from the first flap;

the first side panel tab separably inserting into and passing through the first panel slot to extend underneath the main panel;

the first side panel further having a locking tab engaging a second side panel having a second printed side, such that when the first side panel and the second side panel are moved away from the top surface extending under the palleted items and held together by the locking tab, the first printed side and the second printed side face away from and are positioned substantially adjacent the plurality of pallets, the first and second side panels being detachable from one another.

12. The apparatus of claim 11 wherein the main panel further has a second flap hingedly coupled to the main panel along a second fold line having a second side panel slot.

13. The apparatus of claim 11 wherein the locking tab engages the second side panel such that when the first side panel and the second side panel are folded toward the palleted items, the first printed side and the second printed side face the palleted items.

14. The apparatus of claim 11 wherein the main panel comprises two opposing first flaps and two opposing second flaps.

15. The apparatus of claim 11 wherein the pallets each have a first top edge in collinear alignment with the first fold line, and a second top edge in collinear arrangement with the second fold line.

16. The apparatus of claim 11 wherein the first side panel is shorter in length than the second side panel.

17. The apparatus of claim 11 wherein the main panel completely covers the pallet.

18. The apparatus of claim 11 wherein the first side panel and the second side panel are sized to hide the plurality of stacked pallets.

19. The apparatus of claim 11 wherein the main panel, the first side panel and the second side panel are made of corrugated cardboard.

20. An apparatus for displaying palleted items on a pallet, the apparatus comprising:

at least one pallet having a top surface peripherally defined by a plurality of top edges, the pallet being stackable with at least one other pallet;

a substantially planar main panel disposed over the top surface of the pallet;

a first flap hingedly coupled to the main panel along a first fold line aligned with one of the top edges of the pallet;

a first side panel slot formed along the first fold line between the main panel and the first flap;

a first side panel having a first printed side, the first side panel hingedly coupled to a first side panel tab, the first side panel being detachable from the first flap;

the first side panel tab separably inserting into and passing through the first panel slot to extend underneath the main panel, the first side panel further having a locking tab;

a second side panel having a second printed side, the second side panel hingedly coupled to a second side panel tab;

wherein the first and second side panels are detachable from one another, and the locking tab engages the second side panel, such that when the first side panel and the second side panel are folded away from the top surface extending under the palleted items and held together by the locking tab, the first printed side and the second printed side immovably face away from and are positioned substantially adjacent the pallet.

* * * * *